United States Patent [19]

Tyler

[11] Patent Number: 4,736,554

[45] Date of Patent: Apr. 12, 1988

[54] BOLT SYSTEM

[76] Inventor: Kent W. Tyler, 1200 NW. 13th St., Boca Raton, Fla. 33439

[21] Appl. No.: 808,674

[22] Filed: Oct. 16, 1985

Related U.S. Application Data

[63] Continuation-in-part of Ser. No. 663,575, Oct. 22, 1984, abandoned.

[51] Int. Cl.[4] ..... E04B 1/00

[52] U.S. Cl. ..... 52/105; 52/295; 52/700; 249/93

[58] Field of Search ..... 52/105, 292, 293, 295, 52/699, 700; 249/93, 210; 260/275

[56] References Cited

U.S. PATENT DOCUMENTS

| | | | |
|---|---|---|---|
| 2,551,834 | 5/1951 | Ferguson | 411/431 |
| 2,724,261 | 11/1955 | Rensaa | 52/295 |
| 3,960,356 | 6/1976 | Adams | 249/93 |
| 3,963,210 | 6/1976 | Macklin | 52/295 |
| 4,261,544 | 4/1981 | Addison | 249/93 |
| 4,438,607 | 3/1984 | Nelson | 52/295 |
| 4,496,264 | 1/1985 | Casey | 52/725 |

*Primary Examiner*—John E. Murtagh
*Assistant Examiner*—Andrew Joseph Rudy
*Attorney, Agent, or Firm*—Malin, Haley & McHale

[57] ABSTRACT

A method and apparatus for locating and positioning a plurality of anchor bolts in concrete to provide a tie down apparatus for columns and posts. The apparatus includes two or more anchor bolts passing through and welded to a locator plate. The anchor bolts are turned at the lower end and are threaded at the upper end. The anchor bolts are positioned, aligned and set in relationship to one another with the longitudinal center lines of the anchor bolts positioned parallel to one another in a predetermined spaced apart relationship to the locator plate that is positioned perpendicular to the longitudinal center lines of the anchor bolts. The locator plate is adjustably connected to removable cross members which are supported by forms in a final position during the pouring of support concrete around and beneath the tie down apparatus.

8 Claims, 5 Drawing Sheets

Fig. 6.
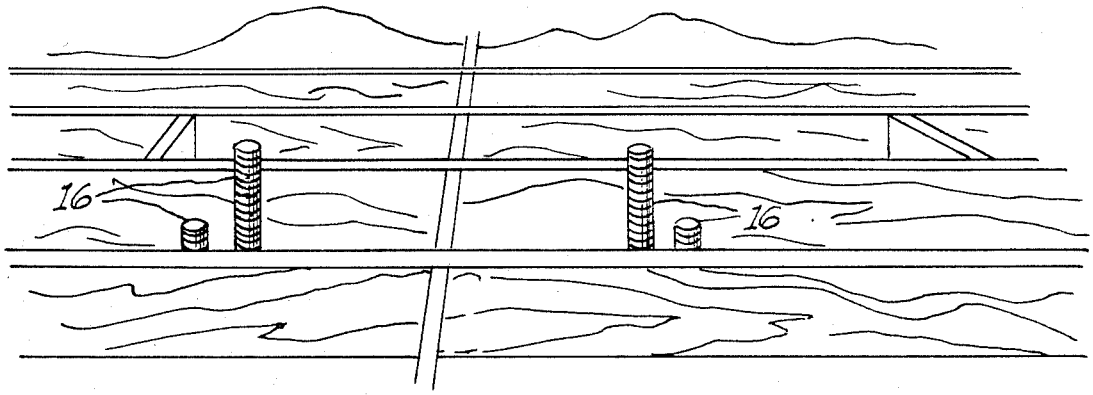
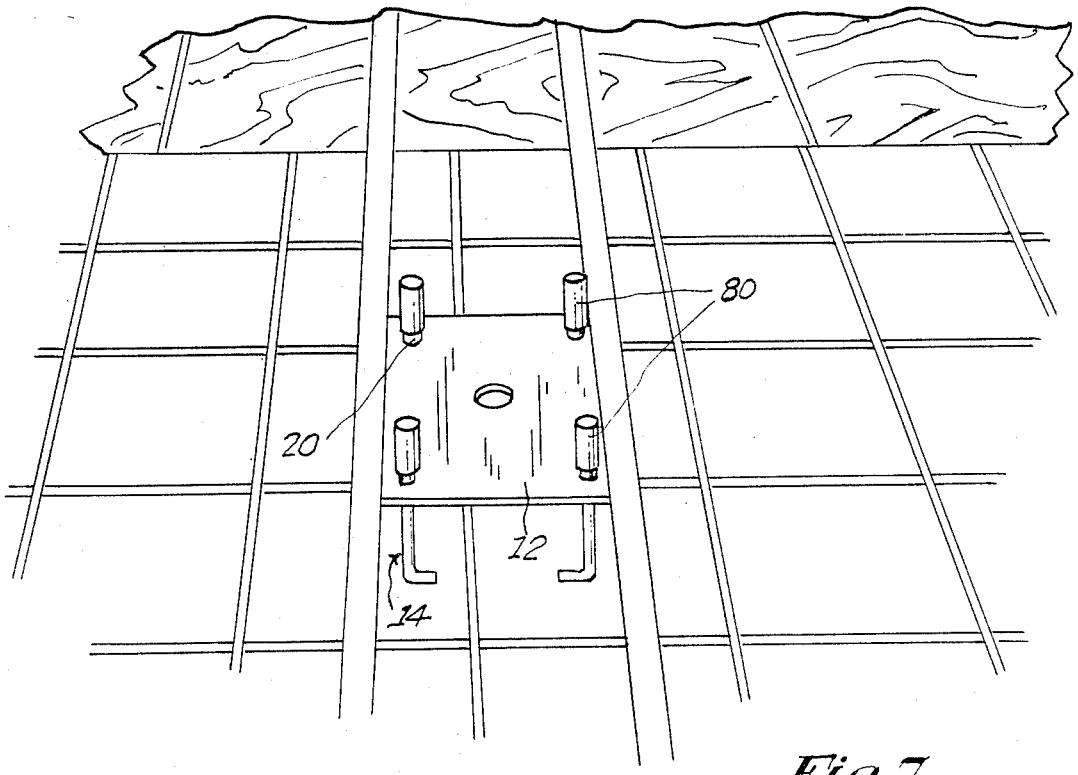
Fig. 7.

BOLT SYSTEM

This application is a continuation-in-part of application Ser. No. 663,575, filed Oct. 22, 1984, now abandoned.

BACKGROUND OF THE INVENTION

This is a new and improved anchor bolt system for locating and positioning a new and improved anchor bolt fixture in concrete to provide a tie down fixture for other structures.

In the past the anchor bolts were positioned in a piece of ¾" ply wood. The flat wooden piece and the anchor bolts were fixed to cross member to hold the bolts and wooded piece in place. Concrete is thereafter poured around the lower end of the anchor bolts and the bottom of the wooden piece. After the concrete hardens the removal of the wooden piece and the alignment of the upper end of the bolts requires great expense and labor. The present invention is to provide a non-complex fixture and method of alignment to lower construction costs and provide an accurate and precise bed with anchor bolts for other structures to be attached.

SUMMARY OF THE INVENTION

This invention is to an anchor bolt system and anchor bolt fixture that is easily connected for adjustment to two cross beams by connectors. Cross-beams and the anchor bolt fixture is positioned on concrete construction forms in a final position. Thereafter the support concrete is poured around the lower portion of the anchor bolt fixture and beneath and in contact with a locator plate in the anchor bolt fixture. The tie down apparatus.

The anchor bolt fixture includes a plurality of anchor bolts. Each anchor bolt is a long member with a turned lower end to anchor the bolt in concrete and a threaded upper end for connecting structural elements and an intermediate portion welded to a locator plate. Two, three, four or more anchor bolts are positioned and aligned in relationship to one another with the longitudinal center lines of the anchor bolts positioned parallel to one another. The locator plate is drilled at predetermined positions to position the anchor bolts in a predetermined spaced apart relationship to each other anchor bolt. After the anchor bolts are placed through the drilled holes the intermediate portion is welded to the locator plate after the longitudinal center lines of the anchor bolts are positioned perpendicular to the plane of the locator plate. The center portion of the locator plate is removed to provide an inspection opening to make sure that the poured concrete comes into contact with and supports the entire bottom of the locator plate.

The locator plate positions the anchor bolts and provides a platform for positioning the anchor bolt fixture somewhat in the generally horizontal surface of the concrete support. The edges of the locator plate are provided with connector opening such as nails to connect the locator plate to cross beams prior to pouring concrete around the anchor bolts.

It is an object of this invention to provide a noncomplex anchor bolt fixture.

It is another object of this invention to provide a non-complex anchor bolt system for placing the fixture in place on a concrete support.

It is a further object of this invention to provide an anchor bolt system for locating and positioning a plurality of anchor bolts in concrete to provide a tie down for other structures that includes an anchor bolt fixture including a flat locator plate for positioning the anchor bolt fixture and locator plate flat against a concrete support surface with at least two anchor bolts connected to said flat locator means and positioned partially in the concrete support surface. Each of said anchor bolts having a threaded end portion, a long mid-portion and a threaded portion opposite the anchor end portion. The anchor bolts are positioned parallel to one another in a predetermined spaced apart relationship and perpendicular to the locator plate. The flat locator plate has a center opening for determining that the anchor bolt fixture is properly positioned in the concrete support.

It is an additional object to provide a small anchor bolt system for holding down ledger strips on house construction.

In accordance with these and other objects which will be apparent hereinafter, the instant invention will now be described with particular reference to the accompanying drawings.

BRIEF DESCRIPTION OF THE DRAWING

In the drawing:

FIG. 6 is a side view of FIG. 5.

FIG. 7 is another perspective view of FIG. 6 above steel.

DESCRIPTION OF THE PREFERRED EMBODIMENT

Figure 2:
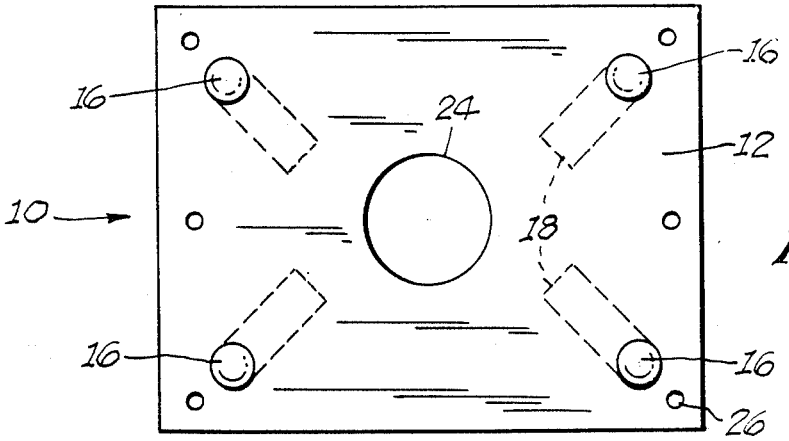
FIG. 2 is a top view of the anchor bolt fixture.
Figure 1:
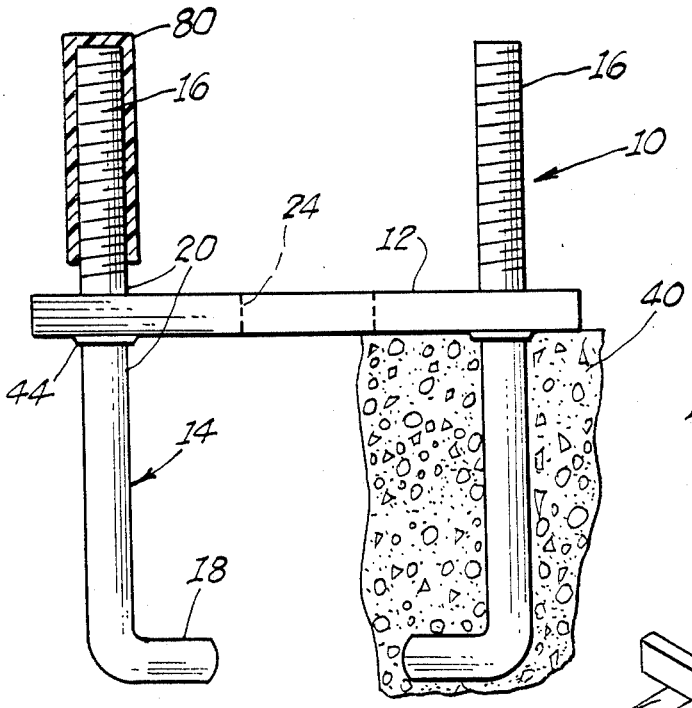
FIG. 1 is a side view of the anchor bolt fixture.
Figure 3:
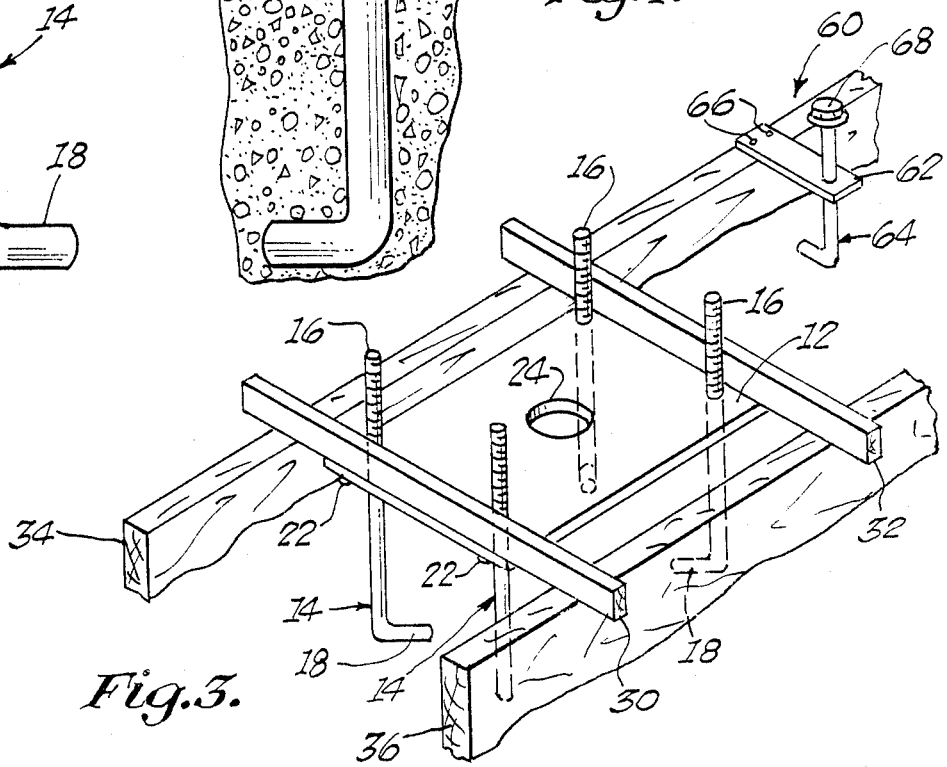
FIG. 3 is an isometric view of the anchor bolt system as the anchor bolt fixture is positioned to pour cement around a portion of the anchor bolts.
Figure 4:
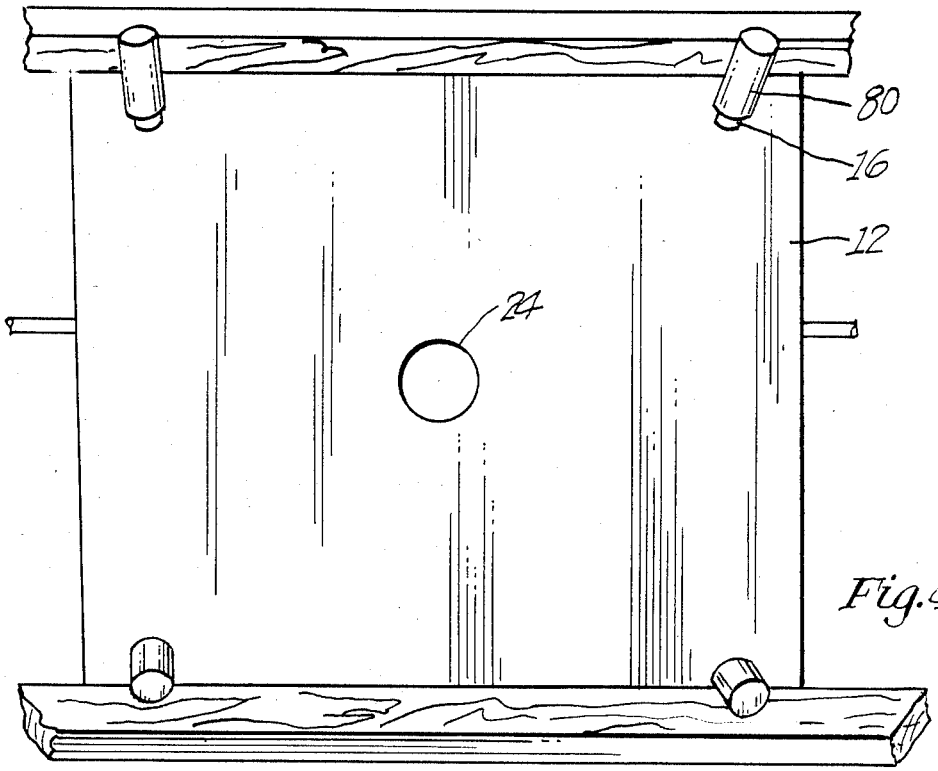
FIG. 4 is a top view of the anchor bolt fixture and cross beams in place in a form with a plastic coating around the threaded portion to protect the threads from concrete and dirt.
Figure 5:
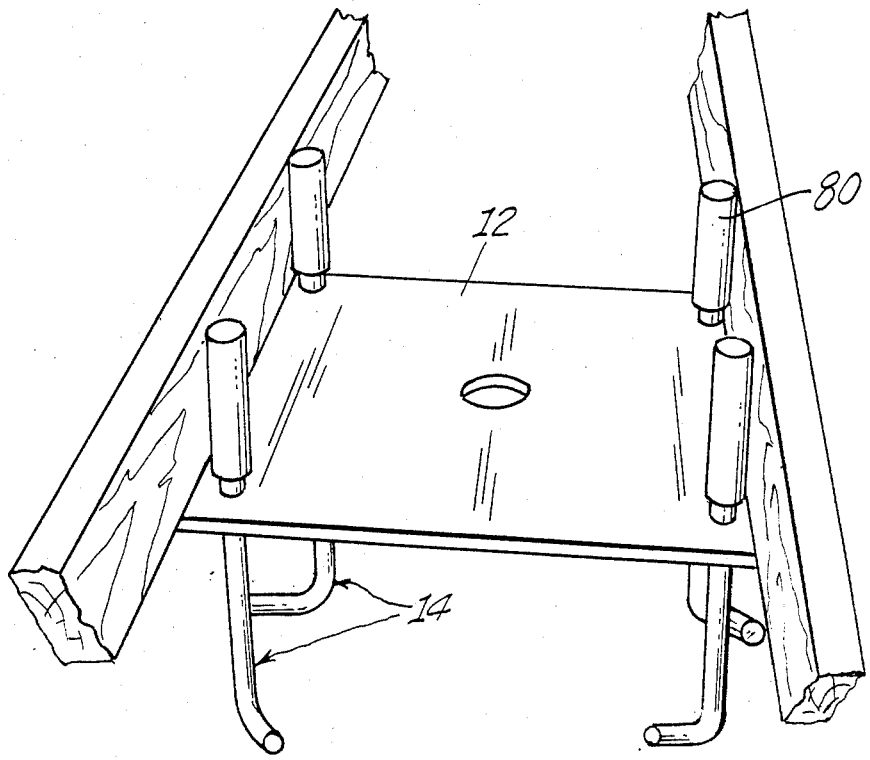
FIG. 5 is a perspective view of FIG. 4.
Figure 8:
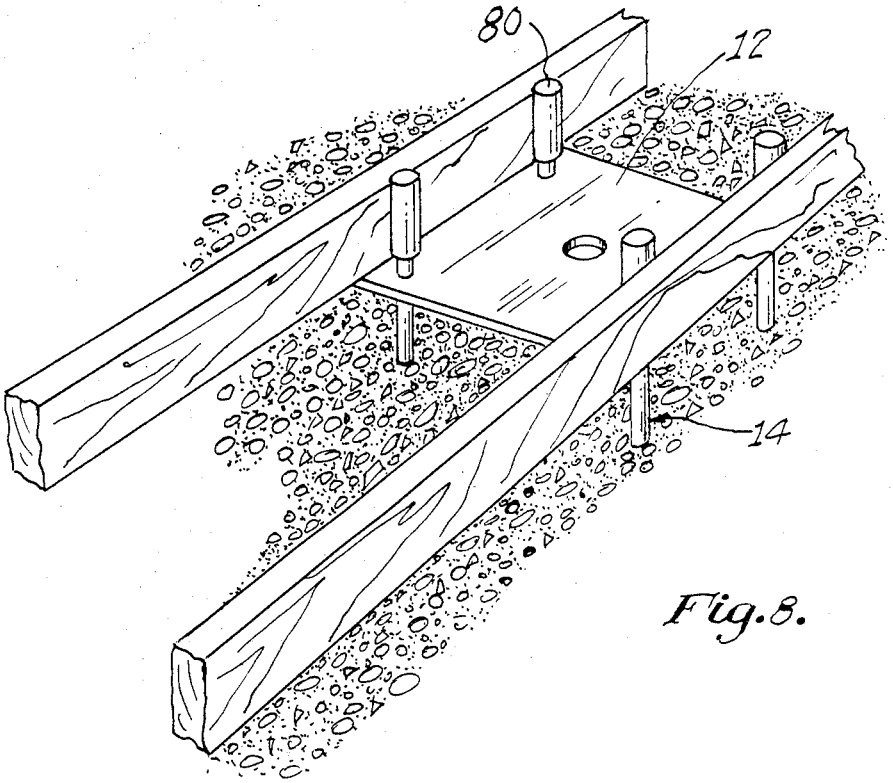
FIGS. 8, 9 and 10 are perspective views of the anchor bolt fixture and cross beams with concrete being poured.
Figure 9:
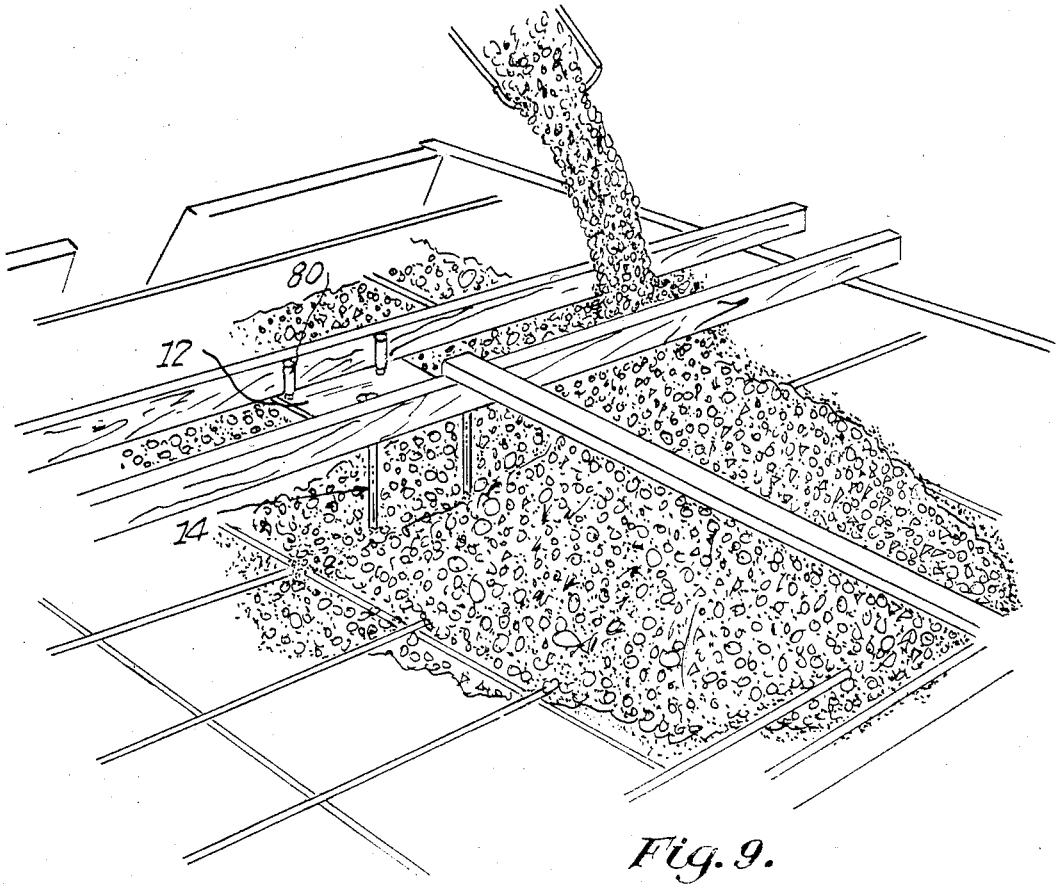
Figure 10:
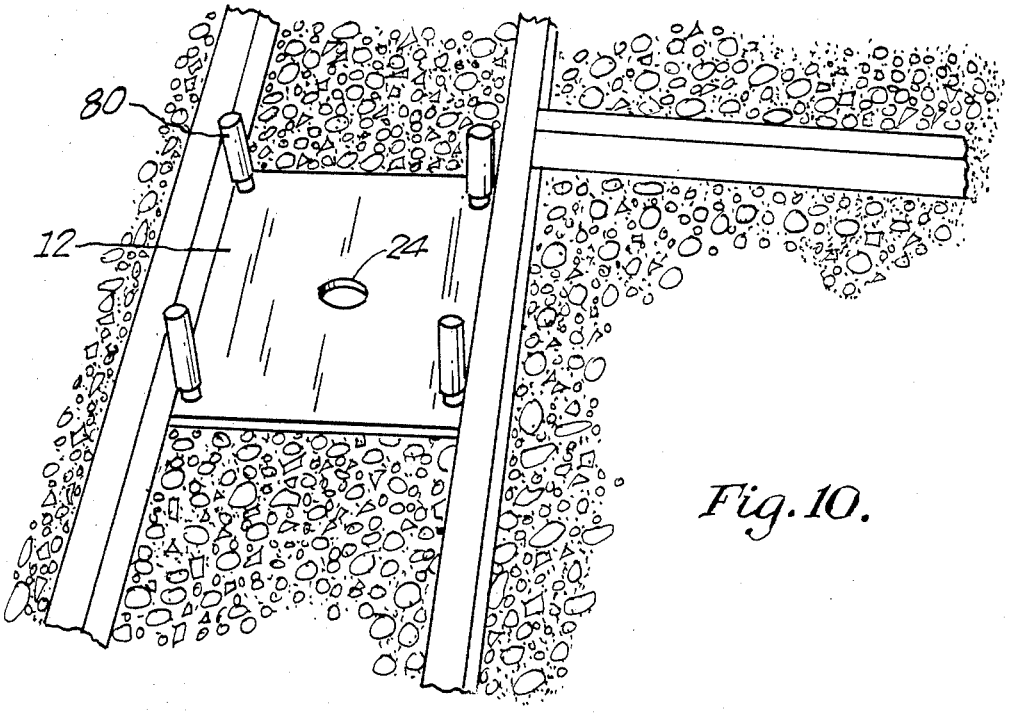
Figure 11:
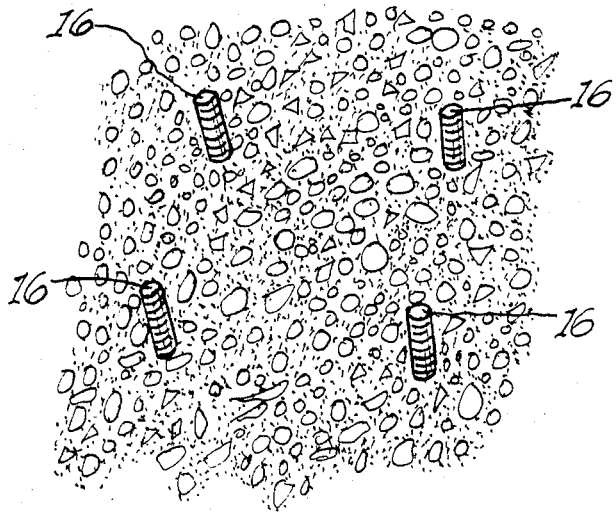
FIG. 11 is a perspective view of the anchor bolt fixture and cross beams after the concrete is poured.
Figure 12:
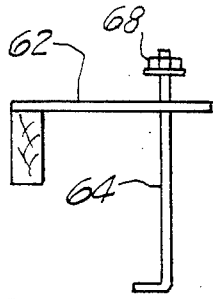
FIG. 12 is a perspective view of a small anchor bolt fixture.

This invention is to an anchor bolt system illustrated in FIG. 3 having an anchor bolt fixture 10 shown in FIGS. 1 and 2 for use as a tie down apparatus for the structures. The anchor bolt fixture 10 is connected to two cross beams 30 and 32 and is adjusted by the connectors 22 between the cross beams 30 and 32 and the anchor bolt fixture 10. The adjustment thereafter positions the anchor bolt fixture 10 in a final position before concrete is poured between forms 34 and 36. A portion of the anchor bolt fixture 10 beneath the flat locator plate 12 that holds anchor bolts 14.

The anchor bolt fixture 10 includes a plurality of anchor bolts 14 and the flat locator plate 12. The anchor bolts 14 are long members with a turned lower end 18 to anchor the bolt in concrete 40 and a threaded upper end 16 with an intermediate portion 20 that is welded at 44 to the flat locator plate 12. Two, three, four or more anchor bolts 16 are positioned and aligned in relationship to one another with the longitudinal center lines of the anchor bolts positioned parallel to one another. The flat locator plate 12 is drilled at predetermined positions to position the anchor bolts 14 in a predetermined spaced apart relationship to each other anchor bolt 10. After the anchor bolts 10 are placed through the drilled holes the intermediate portion of the anchor bolts are welded at 44 to the flat locator plate 12, but only after the longitudinal center line of the anchor bolts are positioned perpendicular to the plane of the locator plate. The center portion of the flat locator plate is removed as shown at 24 to provide an inspection opening to make sure that when the concrete is poured it is placed in contact with and supports the bottom of the flat locator plate as shown in FIG. 1.

The flat locator plate 12 positions the anchor bolts 14 and provides a platform for positioning other structures. The edges of the locator plate are provided with connector opening 26 to tie down apparatus prior to pouring concrete around the anchor bolts. Nails 22 may be used.

A small anchor bolt fixture 60 may be attached as shown in FIG. 3 to connect or may be placed with the longitudinal center line of the anchor bolt 64 in a horizontal position, as in a tie beam, to mount a ledger strip. The small anchor bolt fixture 60 includes an anchor bolt 64 with nut 68 thereon. The threads and bolt may be covered by a plastic coating 80, shown in FIG. 1, to protect the threads from concrete and dirt. The plate 62 is shaped as illustrated in FIG. 3 and includes nail holes. Nails 66 may be used to attach the small anchor bolt fixture 60 to the form 34.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An anchor bolt system locating and positioning a plurality of anchor bolts in concrete to provide a tie down for structures comprising:

an anchor bolt fixture including a flat locator means for positioning said anchor bolt fixture flat against a concrete surface to be poured, and at least two anchor bolts connected to said flat locator means;

each of said anchor bolts having a threaded end portion and a mid-portion having a longitudinal center line;

each of said anchor bolts having an anchor end portion opposite said threaded end portion;

said anchor bolts positioned, aligned and set in relationship to one another with each said longitudinal center line positioned parallel to one another in a predetermined spaced apart relationship;

said mid-portion of each said anchor bolts connected to said flat locator means;

said longitudinal center lines of each of said anchor bolts positioned perpendicular to said flat locator means, and said flat locator means having a center means positioned in the center of said flat locator means, said center means for determining that said anchor bolts are properly embedded in concrete with concrete to the level of said center means.

2. An anchor bolt system as set forth in claim 1, wherein:

said flat locator means having connector means for connecting said anchor bolt fixture to removable cross means;

said flat locator means is a plate.

3. An anchor bolt system as set forth in claim 2, wherein:

said center means is an inspection aperture in the center of said flat locator plate; and said connector means are connector apertures.

4. An anchor bolt system as set forth in claim 3, including:

connector means;

removable cross means connected to said flat locator means by said connector means for supporting said anchor bolt fixture with each said anchor end portion in concrete and said flat locator means in contact with the surface of the concrete.

5. An anchor bolt system locating and positioning at least one anchor bolt in concrete to provide a tie down for structures comprising:

each said anchor bolt fixture including a flat locator means for positioning said anchor bolt fixture in a concrete surface to be poured, and each said anchor bolt connected to said flat locator means;

each said anchor bolt having a threaded end portion and a mid-portion having a longitudinal center line;

each said anchor bolt having an anchor end portion opposite said threaded end portion;

each said anchor bolt positined, aligned and set in relationship with each said longitudinal center line positioned in a predetermined relationship with said flat locator means;

each said anchor bolt having said mid-portion connected to said flat locator means;

each said threaded end portion above said mid-portion covered with a removable material means for protecting the threads; during pouring of the concrete and each said flat locator means having connector opening for attaching said anchor bolt fixture to a form.

6. An anchor bolt system locating and positioning at least one anchor bolt in concrete to provide a tie down for structures comprising:

an anchor bolt fixture including a flat locator means with a center portion, said flat locator means for positioning said anchor bolt fixture in a concrete surface to be poured, said anchor bolt fixture including adjustable connector means for each said anchor bolt, and said anchor bolt fixture including each said anchor bolt connected to said adjustable connector means in said flat locator means;

each said anchor bolt having a threaded end portion and a mid-portion having a longitudinal center line;

each said anchor bolt having an anchor end portion opposite said threaded end portion;

each said anchor bolt positioned, aligned and set in relationship with each said longitudinal center line positioned in a predetermined radially adjustable relationship in said adjustable connector means in said flat locator means;

said mid-portion of each said anchor bolt adjustably along said center line and connected to said flat locator means; and said adjustable connector means including a long slot for adjustable movement of each said anchor bolt from said center portion and any other anchor bolts.

7. An anchor bolt system as set forth in claim 6, including:

a center means positioned in said center portion of said flat locator means, said center means for determining that said anchor bolts are properly embedded in concrete up to said center means in said flat locator means.

8. An anchor bolt system as set forth in claim 7, including:

a removable material means connected to the threads of each said portion above said mid-portion, said material means for protecting the threads above said midportion;

said flat locator means having connector opening for attaching said anchor bolt fixture to a form.

* * * * *